US005902456A

United States Patent [19]

Sundqvist et al.

[11] Patent Number: 5,902,456

[45] Date of Patent: May 11, 1999

[54] DEWATERING APPARATUS

[75] Inventors: Ingemar Sundqvist, Bergeforsen; Bert Häggström, Sundsvall; Olof Swärdh, Sundsbruk, all of Sweden

[73] Assignee: Sunds Defibrator Industries AB, Sweden

[21] Appl. No.: 08/849,644

[22] PCT Filed: Dec. 11, 1995

[86] PCT No.: PCT/SE95/01496

§ 371 Date: May 29, 1997

§ 102(e) Date: May 29, 1997

[87] PCT Pub. No.: WO96/18495

PCT Pub. Date: Jun. 20, 1996

[30] Foreign Application Priority Data

Dec. 12, 1994 [SE] Sweden ..... 9404336

[51] Int. Cl.[6] ..... B30B 9/20; D21C 9/18

[52] U.S. Cl. ..... 162/358.1; 100/174; 210/407; 210/396; 162/323

[58] Field of Search ..... 162/232, 358.1, 162/281, 323; 100/121, 174; 210/402, 396, 407, 408

[56] References Cited

U.S. PATENT DOCUMENTS

| | | | |
|---|---|---|---|
| 4,782,747 | 11/1988 | Unger et al. | 100/121 |
| 5,021,124 | 6/1991 | Turtinen et al. | 162/281 |
| 5,032,229 | 7/1991 | Boucher | 162/281 |
| 5,107,757 | 4/1992 | Oshita et al. | 100/121 |
| 5,667,642 | 9/1997 | Luthi | 162/358.1 |

FOREIGN PATENT DOCUMENTS

| | | |
|---|---|---|
| 27 09 915 | 9/1978 | Germany . |
| 302 717 | 7/1968 | Sweden . |
| 87/06282 | 10/1987 | WIPO . |

*Primary Examiner*—Karen M. Hastings
*Attorney, Agent, or Firm*—Lerner, David, Littenberg. Krumholz & Mentlik, LLP

[57] ABSTRACT

Apparatus is disclosed for dewatering pulp suspensions including a pair of cylindrical rotatable liquid-premeable press rolls forming a nip therebetween, so that the material suspension can pass between the nip to be dewatered and to form a material web, a pair of doctor blades disposed below the nip, each associated with one of the press rolls for removing the material web therefrom, and a sealed casing enclosing at least the upper portion of the pair of press rolls, the sealed casing including an inlet for the material suspension, and the pair of doctor blades being coupled together so that they are movable relative to the nip in order to alter the distance between the pair of doctor blades and the nip when the size of the nip is adjusted.

7 Claims, 2 Drawing Sheets

DEWATERING APPARATUS

FIELD OF THE INVENTION

The present invention relates to apparatus for dewatering material suspensions. More particularly, the present invention relates to apparatus comprising a pair of cooperating press rolls, which between themselves form a press nip and in which the press rolls are formed with liquid permeable shell surfaces, whereby the material suspension, for example, a pulp suspension, is dewatered by liquid being pressed through these surfaces by means of an overpressure. The material is finally dewatered to the desired dry matter content in the nip between the rolls.

BACKGROUND OF THE INVENTION

The shell surface of the types of press rolls discussed above consists of a perforated metal sheet, which is welded onto a roll body. In order to achieve a high capacity, the total open area must be large, and at the same time the apertures must be sufficiently small so as to prevent fibers from following along with the liquid through the apertures. In order to solve these problems, the press roll can be covered with a wire cloth on the outer surface of the perforated shell sheet. Such a wire permits liquid flow even along the shell surface. This, in turn, permits the perforations to be given a greater size, whereby the capacity is increased without risking increased fiber passage. Wire-covered press rolls have proven to be particularly advantageous for mechanical pulp, which contains a large amount of fine material. Compared with a perforated metal sheet, the wire cloth permits a smaller amount of fine material to pass through the apertures.

The rolls are generally rotatably mounted on two parallel shafts, and are usually immersed into a trough, which encloses at least the lower half of the rolls. The material suspension is supplied to the space between the rolls and the trough. This space is sealed from the surroundings so that an overpressure can be maintained in the trough whereby the dewatering is facilitated. The pulp is moved from the trough upwards through the nip, where it is simultaneously dewatered. Doctor blades are located after the nip, for the purpose of removing the dewatered pulp web from the rolls. The pulp is then removed by a conveyor for transfer to subsequent processing steps.

By means of this type of dewatering, dry matter contents of up to about 55 to 60% can be obtained. The equipment required for removing the dewatered pulp web from the rolls and for transferring the pulp from below to the conveyor, however, is complicated and sensitive to operational breakdowns. In many cases when a maximum dry matter content is not required, therefore, a simpler dewatering apparatus would be sufficient and quite desirable.

SUMMARY OF THE INVENTION

In accordance with the present invention, these and other objects have now been accomplished by means of a simplified method and a simpler dewatering apparatus in which the dewatered pulp can readily be taken off and conveyed from the apparatus. Thus, by means of the apparatus according to the present invention, the dry matter content of the pulp can be increased from about 0.5 to 8% up to about 8 to 30%, and preferably from about 1 to 5% up to about 8 to 15%.

In accordance with the present invention, apparatus is provided for dewatering a material suspension comprising a pair of cylindrical, rotatable, liquid-permeable press rolls juxtaposed with each other so as to form a nip therebetween, whereby the material suspension can pass between the nip in order to be dewatered and to form a material web therefrom, a pair of doctor blades disposed below the nip, each of the pair of doctor blades being associated with one of the pair of press rolls for removing the material web from the pair of press rolls, and a sealed casing enclosing at least the upper portion of the pair of press rolls, the sealed casing including an inlet for the material suspension, the pair of doctor blades being coupled to each other whereby the pair of doctor blades are movable relative to the nip so as to alter the distance between the pair of doctor blades and nip when the size of the nip is adjusted.

In accordance with one embodiment of the apparatus of the present invention, the apparatus includes transport means for transporting the material web after it is separated from the pair of nip rolls, the transport means being located beneath the nip.

In accordance with another embodiment of the apparatus of the present invention, the apparatus includes a wire cloth covering the surface of the pair of press rolls.

In accordance with another embodiment of the apparatus of the present invention, the inlet includes a distributor including a pair of openings for directing the material suspension laterally within the sealed casing. Preferably, the distributor includes a filling member extending along the length of the sealed casing along the nip between the sealed casing and a pair of press rolls.

BRIEF DESCRIPTION OF THE DRAWINGS

The present invention may be more fully appreciated with reference to the following detailed description, which, in turn, refers to the Figures in which.

DETAILED DESCRIPTION

Figure 1:
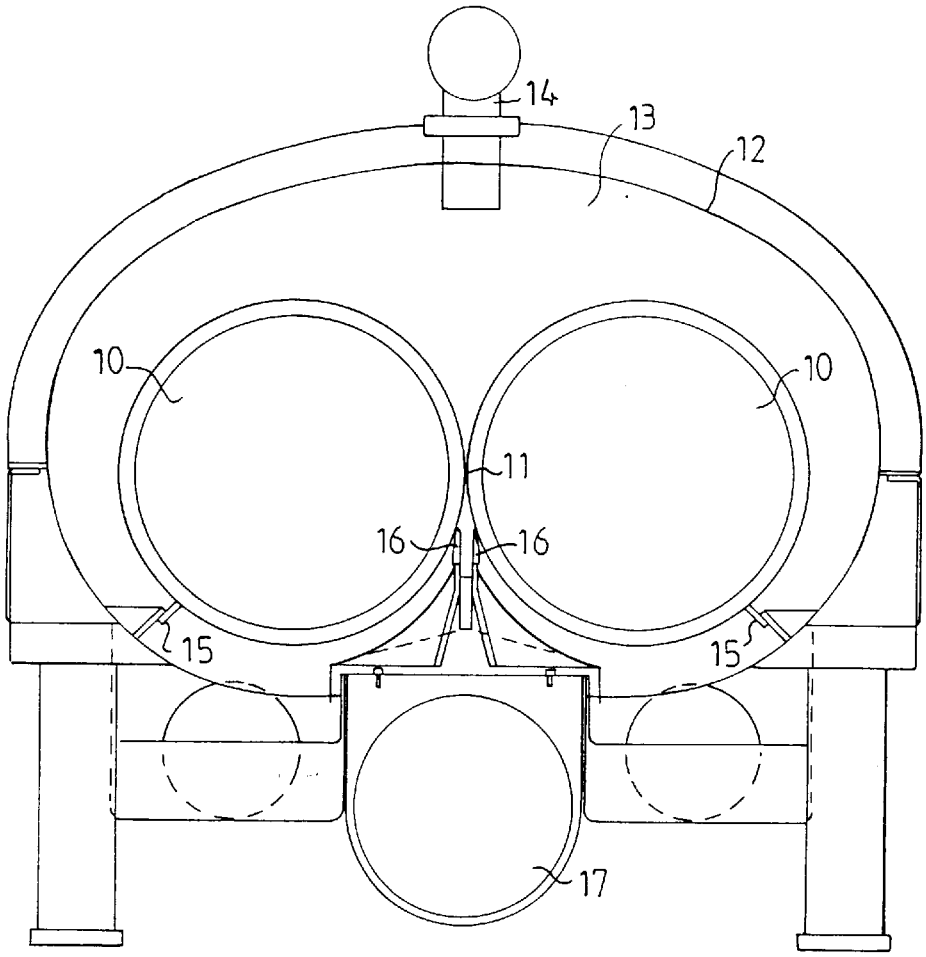
FIG. 1 is a side, elevational, cross-sectional view of a dewatering apparatus in accordance with the present invention.
Figure 2:
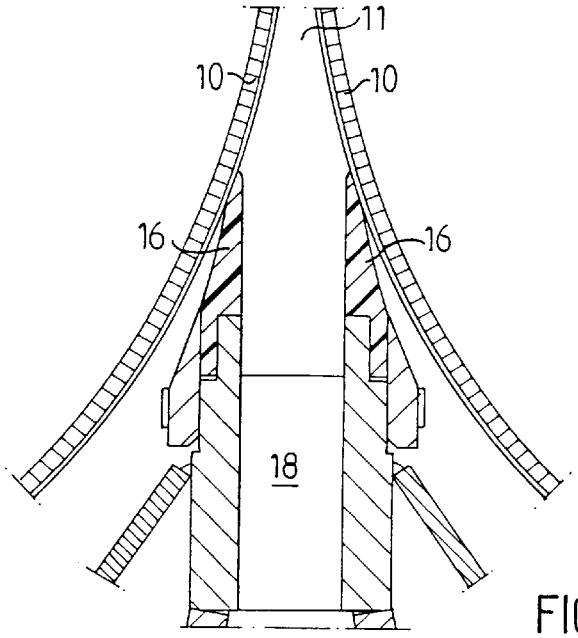
FIG. 2 is a side, elevational, enlarged sectional view of a portion of the apparatus shown in FIG. 1 showing the doctor blades thereof.

Referring to the Figures, in which corresponding reference numerals refer to corresponding elements thereof, the apparatus shown in FIG. 1 comprises two cylindrical rotary liquid permeable press rolls 10. The shell surface of the press rolls 10 consists of a perforated metal sheet, which is attached, preferably by welding, to a roll body. On the outer surface of the perforated sheet, a wire cloth can be located. Such a wire cloth is preferably made of plastic wires. The rolls 10 form between themselves a press nip 11. The upper portion of the rolls 10 is enclosed in a casing 12 in a manner such that a space 13 is formed above the rolls 10. An inlet 14 for the material suspension is connected to the casing 12.

The space 13 is sealed from the surroundings by means of sealings 15 toward the shell surfaces of the rolls 10 and by sealings (not shown) applied to the end walls of the rolls. The pulp web in the press nip 11 acts as a seal between the rolls.

Doctor blades 16 below the press nip 11 ensure transfer of the pulp web exiting from the nip 11, and at the same time prevent re-wetting of the material. Below the doctor blades is located a collecting means for the pulp, for example a conveying screw 17 or a tank.

At least one of the press rolls is adjustable in order to control the size of the nip 11. The doctor blades 16, together with their associated press rolls, are adjustable in a corresponding manner. The doctor blades can abut the press rolls, but in the case of wire-covered press rolls a small distance, preferably between about 1 and 0.5 mm must be maintained between the doctor blade and the roll.

Such adjustability is preferably brought about by designing one of the press rolls 10 and associated doctor blade 16 to be stationary, and the other press roll and associated doctor blade to be movable. It is also possible to couple the two doctor blades 16 to each other. The doctor blades are then capable of moving to and from the nip 11 together, in order to maintain the distance to the shell surfaces when controlling the nip size. The doctor blades 16 can be coupled together by means of distance members 18 located at both ends of the doctor blades. A number of distance members 18 can also be arranged along the length of the doctor blades and be designed so as to interfere with the pulp web as little as possible.

The doctor blades 16 should extend as long a distance as possible into the nip 11 in order to prevent as much re-wetting of the pulp web after the nip as is possible; i.e., due to liquid penetration outwardly through the shell surfaces of the rolls after the nip. The size of the nip should be between about 1 and 5 mm.

The distance between the two doctor blades 16 in relation to the size of the nip 11 should be in the interval of about 10:1 to about 25:1. The angle between the two doctor blades 16 should be between 0 and 30°, and preferably between about 5 and 15°.

The material suspension to be dewatered is supplied in a simple manner through one or more inlets 14, so that the space 13 is filled by the suspension. By maintaining an overpressure in space 13 the liquid is pressed through the permeable shell surfaces of the rolls 10 while the material is simultaneously deposited on these surfaces. The material is moved by rotation of the rolls through the nip 11. Below the nip, the material is transferred from the rolls by means of gravity, and the material drops down onto the conveyor 17. The doctor blades 16 ensure transfer of the material web from the rolls.

This arrangement ensures that a certain amount of re-wetting of the dewatered pulp web is unavoidable, but it is still possible to increase the dry matter content from about 0.5 to 8% up to about 8 to 30%, preferably from about 1 to 5% up to 8 to 15%. In many cases, this is entirely sufficient in view of the conditions which are desired in subsequent processes. The advantage of this apparatus lies in the simplicity and reliability of the dewatering by utilization of a simplified device. The transfer of the dewatered material web takes place by the effects of gravity, and the pulp can be readily collected and analyzed further in a reliable manner.

Figure 3:
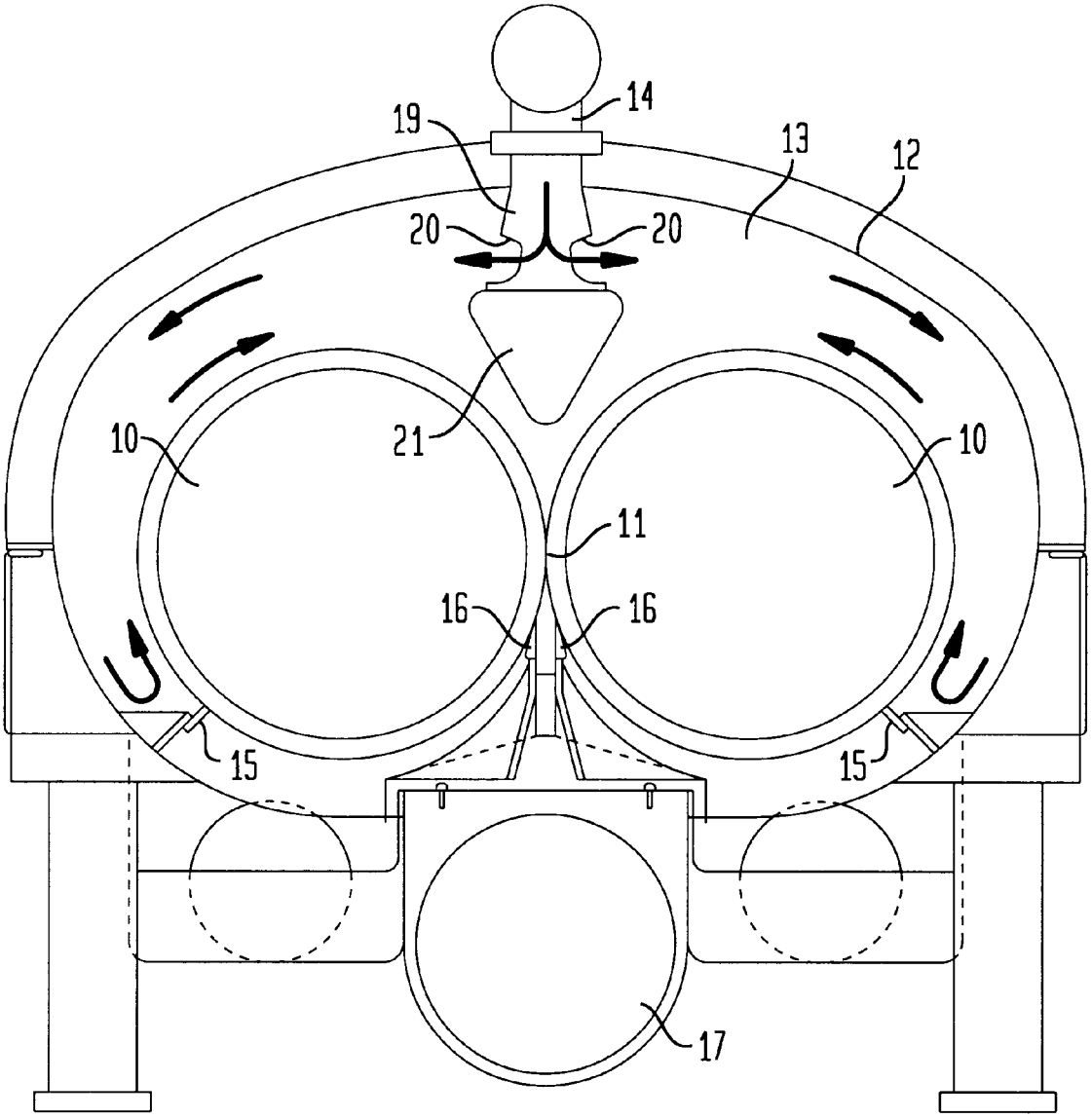
FIG. 3 is a side, elevational, cross-sectional view of another embodiment of the dewatering apparatus of the present invention.

The apparatus shown in FIG. 3 corresponds substantially to the embodiment shown in FIG. 1, but in this case it is provided with a distribution device 19 connected to each inlet 14. Each distribution device 19 has openings 20 arranged laterally therein, so that the flow of the supplied material suspension is directed outwardly along the casing 12 in the space 13. Furthermore, the distribution devices 19 are provided with filling means 21 arranged above the nip 11 and extending along the entire length of the rolls 10. In this manner, the volume available for the suspension in the space 13 is reduced. The cross-section of the filling means 21 should preferably be substantially triangular.

According to this embodiment of the present invention, the suspension is supplied through the inlets 14 and distributed laterally from the openings 20 of the distribution device 19. In this manner, the two flows follow the casing outwardly and downwardly to the seals 15, where the flows are directed inwardly to the rolls 10 and follow the rolls to the nip 11. These flows are promoted by the filling means 21. As a result of these flows, the deposition of material on the rolls can be performed without disturbances. Thus, the efficiency and capacity of the apparatus can be improved.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for dewatering a material suspension comprising a pair of cylindrical, rotatable liquid permeable press rolls juxtaposed with each other so as to form a nip therebetween, whereby said material suspension can pass between said nip in order to be dewatered and to form a material web therefrom, a pair of doctor blades disposed below said nip, each of said pair of doctor blades being associated with one of said pair of press rolls for removing said material web from said pair of press rolls, and a sealed casing enclosing at least the upper portion of said pair of press rolls, said sealed casing including an inlet disposed above said nip for said material suspension, said pair of doctor blades being coupled to each other above a collecting means for said material web and movably mounted together, so as to be movable between a first position distal from said nip and a second position proximate to said nip whereby the distance between said pair of doctor blades and said nip can be altered when the size of said nip is adjusted.

2. The apparatus of claim 1 wherein said collecting means includes transport means for transporting said material web after it is separated from said pair of press rolls, said transport means being located beneath said nip.

3. The apparatus of claim 1 including a wire cloth covering the surface of said pair of press rolls.

4. The apparatus of claim 1 wherein said inlet includes a distributor including a pair of openings for directing said material suspension laterally within said sealed casing away from said nip.

5. The apparatus of claim 4 wherein said distributor includes a filling member extending along the length of said sealed casing along said nip between said sealed casing and said pair of press rolls.

6. The apparatus of claim 1 wherein the angle between said pair of doctor blades is between about 0 and 30°.

7. The apparatus of claim 1 wherein the distance between said pair of doctor blades in relation to the size of said nip is between about 10:1 and 25:1.

* * * * *